US007849920B2

(12) United States Patent
Kannan et al.

(10) Patent No.: US 7,849,920 B2
(45) Date of Patent: Dec. 14, 2010

(54) SYSTEM AND METHOD FOR OPTIMIZING PRODUCTION IN A WELL

(75) Inventors: Dhandayuthapani Kannan, Missouri City, TX (US); David E. Sask, Calgary (CA); Lang Zhan, Pearland, TX (US); James G. Filas, Saint Cloud (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 132 days.

(21) Appl. No.: 11/960,852

(22) Filed: Dec. 20, 2007

(65) Prior Publication Data

US 2009/0159275 A1 Jun. 25, 2009

(51) Int. Cl.
*E21B 47/00* (2006.01)

(52) U.S. Cl. ..... 166/250.01; 166/115; 166/116; 166/242.2; 166/187

(58) Field of Classification Search ..... 166/250.01, 166/187, 250.07, 250.15, 115, 116, 242.2
See application file for complete search history.

(56) References Cited

U.S. PATENT DOCUMENTS

| | | | | |
|---|---|---|---|---|
| 4,406,461 | A | 9/1983 | McGill | |
| 5,287,741 | A | 2/1994 | Schultz | |
| 5,503,014 | A | 4/1996 | Griffith | |
| 5,505,261 | A | 4/1996 | Huber | |
| 5,638,904 | A | 6/1997 | Misselbrook | |
| 5,826,662 | A | 10/1998 | Beck | |
| 6,073,696 | A * | 6/2000 | Ellis | 166/312 |
| 6,446,727 | B1 | 9/2002 | Zemlak et al. | |
| 6,712,150 | B1 | 3/2004 | Misselbrook et al. | |
| 6,722,438 | B2 * | 4/2004 | Sask | 166/312 |
| 6,851,444 | B1 * | 2/2005 | Kohl et al. | 137/13 |
| 6,959,763 | B2 | 11/2005 | Hook | |
| 6,978,211 | B2 * | 12/2005 | Soliman et al. | 702/13 |
| 7,216,703 | B2 | 5/2007 | Smith | |
| 7,389,787 | B2 * | 6/2008 | Means et al. | 137/13 |
| 7,448,448 | B2 * | 11/2008 | Lovell et al. | 166/279 |
| 2003/0213591 | A1 * | 11/2003 | Kuchuk et al. | 166/250.02 |
| 2008/0115934 | A1 * | 5/2008 | Pettinato et al. | 166/254.1 |
| 2008/0302529 | A1 * | 12/2008 | Fowler et al. | 166/250.01 |
| 2008/0308272 | A1 * | 12/2008 | Thomeer et al. | 166/250.15 |
| 2009/0095471 | A1 * | 4/2009 | Guignard et al. | 166/278 |

FOREIGN PATENT DOCUMENTS

| | | |
|---|---|---|
| GB | 2392461 | 3/2004 |

* cited by examiner

*Primary Examiner*—Jennifer H Gay
*Assistant Examiner*—Elizabeth C Gottlieb
(74) *Attorney, Agent, or Firm*—Kevin B. McGoff; Rodney V. Warfford

(57) ABSTRACT

For optimizing well production, intervals are selected along a deviated wellbore, and a well test and treatment string is deployed in the wellbore. Each interval is then isolated to enable performance of desired testing. The test data obtained is evaluated to determine an appropriate remedial action which is then implemented via the well test and treatment string. The system and method enable the testing and treatment of a plurality of intervals along a horizontal well during the same run downhole.

13 Claims, 5 Drawing Sheets

SYSTEM AND METHOD FOR OPTIMIZING PRODUCTION IN A WELL

BACKGROUND

Horizontal and large deviated wells are widely used for reservoir developments. Theoretically, horizontal wells should be able to produce at several times the rate of comparable vertical wells. In reality, the productivity of a horizontal well is often much less than its potential. The difference between the theoretical and the actual production in horizontal wells may be the result of a number of factors. For example, horizontal wells may have a non-uniform reservoir pressure distribution along the wellbore because horizontal wells tend to be drilled in producing fields, which have unevenly depleted regions. Horizontal wells also may encounter strong formation heterogeneity in reservoirs extending along relatively long wellbores. Horizontal wells also can suffer from formation damage incurred during drilling and from inadequate cleanup processes, particularly towards the tip of the wellbore. Water humps and gas traps also can occur along the tortuous, horizontal wellbore. The non-uniform pressure distribution, strong formation heterogeneity, uneven damage, water humps and gas traps lead to non-uniform production along boreholes of deviated, e.g. horizontal, wells. To improve the productivity of these wells, it is desirable to obtain detailed and non-uniformly distributed information along the wellbore.

Attempts have been made to test horizontal wells for well related limitations on production with the goal of correcting the problems to improve production. However, the available testing tends to be limited and relies on data collected at the heel of the well which generally is only an average of the entire horizontal wellbore section. As a result, any remedial treatment of the horizontal well typically has been performed in a blind fashion without precise knowledge of the areas, extent and type of damage along the horizontal well. Existing testing systems also fail to provide sufficient information in a short period of time. Furthermore, well testing generally is done as a preliminary procedure via, for example, pressure transient testing or production logging. After evaluation, remedial treatment is performed as a separate service during a separate trip downhole.

SUMMARY

In general, the present invention provides a system and method for optimizing well production. Intervals are selected along a deviated wellbore, and a well test and treatment string is deployed in the wellbore. Each of the intervals is then isolated to enable performance of desired tests at each interval. The data obtained is evaluated to determine an appropriate remedial action, and the specific remedial action is implemented via the well test and treatment string. The system and method enable the testing and treatment of a plurality of intervals along a horizontal well during the same run downhole.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a well system for optimizing production in deviated wells, e.g. horizontal wells. The well system may be used as a multi-zone testing and treatment system for addressing productivity problems in deviated wells and for optimizing production from those deviated wells. According to one embodiment, the system and methodology provide answers on an interval specific basis in real time. The information is used to carry out remedial work in-situ which also enables assessment of the improvements made upon implementing specific treatment actions. The overall system allows real time data interpretation, solution determination, and treatment actions carried out in the same run downhole. As a result, the cost of services can be reduced, lost potential revenue is captured, production is optimized, and hydrocarbon recovery is increased.

In the present technique, intervals are selected along a deviated, e.g. horizontal, well. Those intervals are selectively isolated to enable testing of each interval. For example, the testing may include the performance of pressure transient testing which can be followed by appropriate remedial treatment if required. Providing interval specific, real time data enables the simultaneous or near simultaneous testing and treatment of those intervals. The well intervals can be isolated sequentially by, for example, moving progressively from the zone or interval nearest the toe toward the heel of the wellbore. In other embodiments, more than one interval can be tested and/or treated at the same time.

Figure 1:
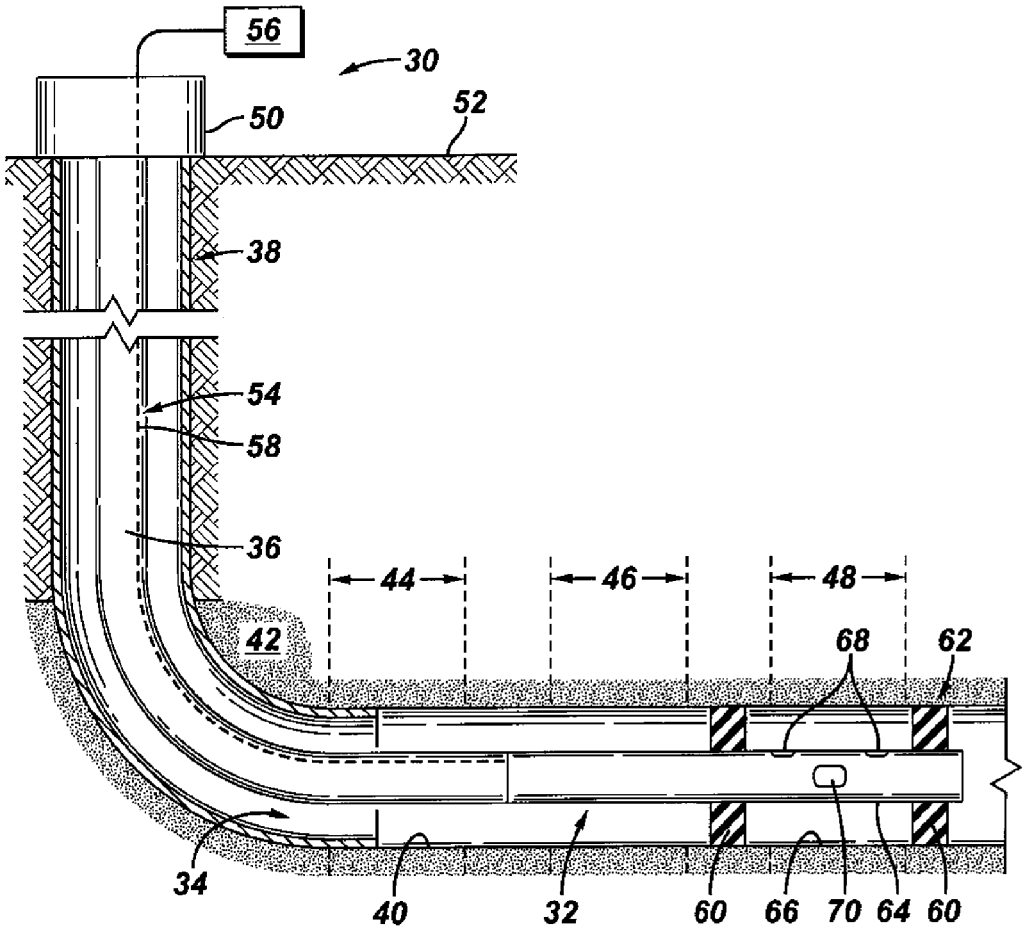
FIG. 1 is a front elevation view of a well system having a well test and treatment string deployed in a deviated wellbore, according to an embodiment of the present invention.

Referring generally to FIG. 1, one embodiment of a well system 30 is illustrated. In this embodiment well system 30 comprises a well test and a treatment string 32 deployed into a wellbore 34 by an appropriate conveyance 36, such as a tubing. The wellbore 34 comprises a generally vertical section 38 and a deviated section 40 that may be substantially horizontal. The deviated section 40 extends through a reservoir 42 and is divided into a plurality of intervals 44, 46, 48 selected for testing and treatment purposes. The number of intervals can vary substantially from one well application to another. For example, well test and treatment string 32 can be utilized in a single well zone or interval, but the system is particularly amenable for use in the testing and treatment of multiple well intervals.

As illustrated, the vertical section 38 of deviated wellbore 34 extends generally between deviated section 40 and a well-head 50 positioned at a surface 52, such as the surface of the earth or a seabed floor. The length of vertical section 38 and the length of deviated section 40 can vary substantially depending on the location of reservoir 42. Accordingly, a data transmission system 54 is adapted to readily transmit data signals between well test and treatment string 32 and a control system 56. Although control system 56 may be positioned in a variety of locations, the control system 56 typically is positioned at a surface location as illustrated. Data can be transmitted between well test and treatment string 32 and control system 56 via a variety of mechanisms, including wireless systems, wired systems, electrical systems, optical systems, hydraulic systems, pulse systems, and other suitable data transmission systems. In many applications, data transmission system 54 comprises a wireline 58 that may be routed within, for example, conveyance 36.

The well test and treatment string 32 can be constructed in a variety of configurations selected for a particular wellbore 34 and reservoir 42. As illustrated, well test and treatment string 32 comprises an isolation mechanism 60 that is selectively actuated to isolate specific well intervals. Isolation mechanism 60 may comprise a pair of packer elements 62 that are expandable between a body 64 of well test and treatment string 32 and a surrounding wellbore wall 66, e.g. a surrounding casing or open wellbore wall. The expandable packer elements 62 may comprise inflatable packer elements that are readily inflated and deflated for selective isolation of a well zone and movement to a subsequent well zone, respectively. By way of example, packer elements 62 can be inflated while straddling zone or interval 48 to enable performance of both testing procedures and treatment procedures at interval 48. The packer elements can then be deflated or otherwise contracted to enable movement of well test and treatment string 32 to a subsequent interval, e.g. interval 46. The packer elements 62 are then expanded to isolate this subsequent interval for appropriate testing and treatment procedures. This process can be repeated for all the selected well intervals.

During testing, data is obtained on the specific interval tested via one or more sensors 68, which are ported to measure the information in the annulus between the tool string 32 and the borehole sandface 40. The types of sensors 68 utilized depend on the reservoir parameters of interest and can include pressure sensors, temperature sensors, oil/gas ratio sensors, density sensors and a variety of other sensors utilized in obtaining information on the subject interval between the two isolation mechanisms 60. In another embodiment of the invention, sensors 68 measure the information not only on the wellbore interval between the two isolation mechanisms 60 but also on the left and right side wellbore intervals that are isolated from the interval between the two isolation mechanisms 60. The information from sensors 68 is transmitted via data transmission system 54 to control system 56 for processing and analysis. This data can be transmitted in real time to enable immediate treatment of the subject zone. Appropriate fluids or other materials can be flowed into each interval during the testing and/or treatment procedures via an appropriate outlet port or ports 70. Sensors 68 also can be used to perform an additional evaluation of the interval post treatment to verify and evaluate the results of the treatment procedure.

Figure 2:
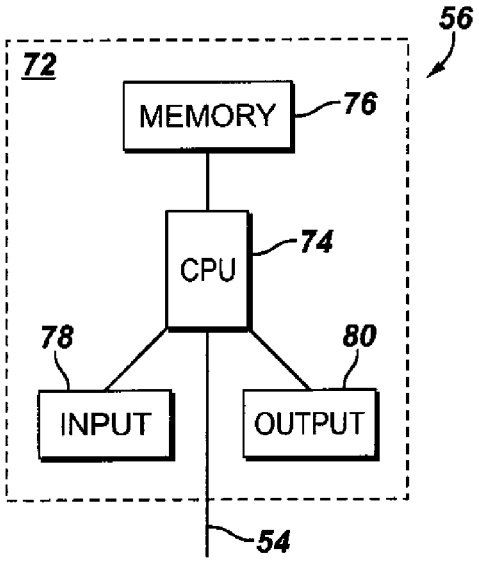
FIG. 2 is a schematic illustration of one embodiment of a control system utilized in the well system of FIG. 1, according to an embodiment of the present invention.

The data provided by sensors 68 is directed to control system 56 which may comprise an automated system 72, such as the processing system diagrammatically illustrated in FIG. 2. In the embodiment illustrated, automated system 72 comprises a computer-based system having a central processing unit (CPU) 74, such as a microprocessor. CPU 74 may be operatively coupled with sensors 68 via data transmission system 54. Additionally, the CPU 74 may be coupled to a memory 76, an input device 78 and an output device 80. Input device 78 may comprise a variety of devices, such as a keyboard, mouse, voice-recognition unit, touchscreen, other input devices, or combinations of such devices. Output device 80 may comprise a visual and/or audio output device, such as a monitor having a graphical user interface. Additionally, the processing of data may be done on a single device or multiple devices at the well location, away from the well location, or with some devices located at the well and other devices located remotely. By way of example, memory 76 may be used to store suitable actions for implementation in response to predetermined scenarios detected by sensors 68. In some applications, CPU 74 and memory 76 can work in cooperation to apply well models based on input data from sensors 68.

Figure 3:
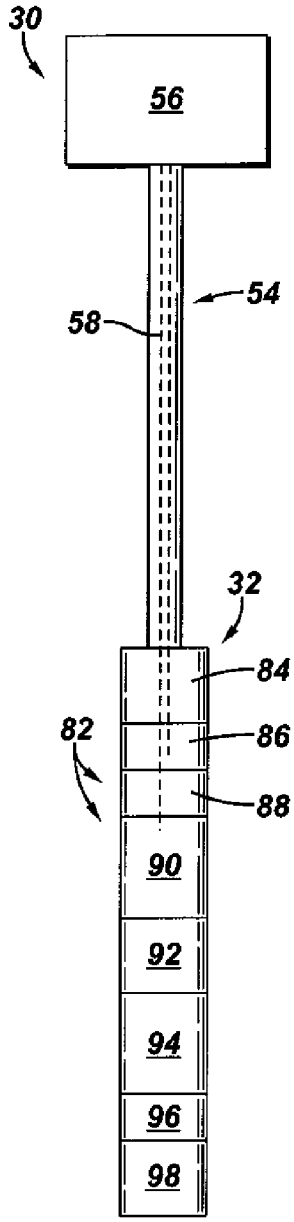
FIG. 3 is a schematic illustration of the control system coupled to a plurality of well test and treatment modules, according to an embodiment of the present invention.

The data collected during test procedures and the capabilities available for well treatment depend, at least in part, on the equipment utilized in well test and treatment string 32. Additionally, the entire well system 30 can be designed as a modular system, as represented schematically in FIG. 3. In the modular embodiment illustrated a variety of modules 82 cooperate to provide the desired functionality for well system 30. At least some of the modules 82 are controlled by and/or provide data to control system 56. Modules 82 also can include primary modules and secondary or supporting modules. However, a wide variety of module combinations can be utilized in diagnosing and treating the multiple intervals in a deviated well.

In the embodiment illustrated, several examples of modules 82 are provided. Examples of primary modules, for example, may comprise a zonal isolation module 84 and a testing module 86. Examples of other primary modules include a production logging module 88, a conveyance and flow module 90, a lateral entry module 92, and a remedial or treatment module 94. The secondary or support modules also may comprise numerous types and combinations of modules, including a telemetry and control module 96 as well as an interpretation and answer module 98 for handling transmitted data. The specific modules are selected based on a variety of factors, including well type, well environment, available equipment, and client requirements.

Figure 4:
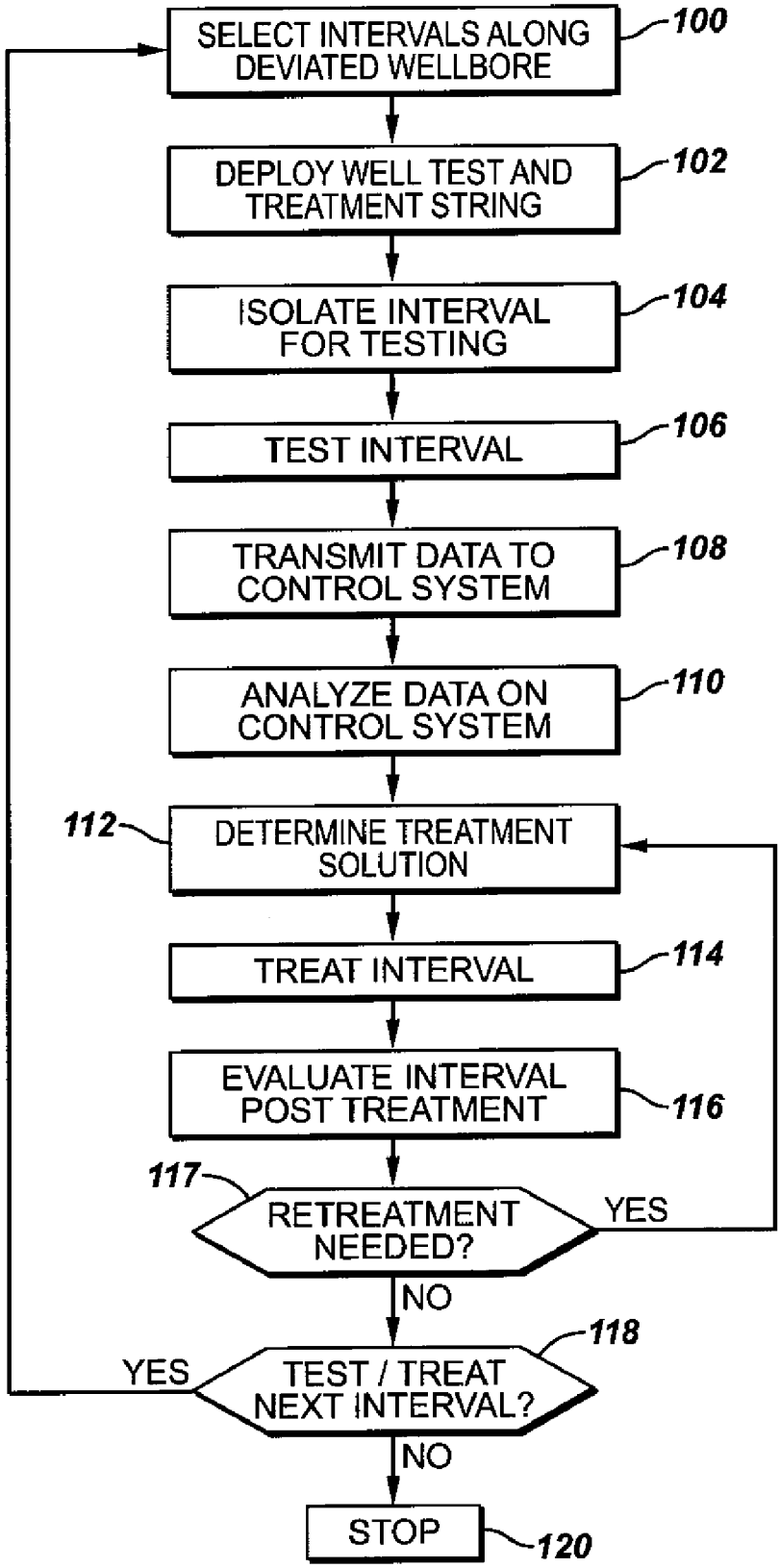
FIG. 4 is a flowchart illustrating one example of a well test and treatment procedure, according to an embodiment of the present invention.

In operation, well system 30 and well test and treatment string 32 can be used to carry out a variety of testing and treatment procedures. One embodiment of such a procedure is illustrated in the flowchart of FIG. 4. In this embodiment, zones or intervals are initially selected along the deviated wellbore section 40, as illustrated by block 100 of the flowchart. The well test and treatment string 32 is deployed into the deviated wellbore, as represented by block 102. An interval is then isolated for testing by isolation mechanism 60, as represented by block 104. Once isolated, desired test procedures can be conducted with respect to the interval, as illustrated by block 106. By way of example, the interval can be tested for parameters such as pressure, skin, vertical and horizontal permeability, reservoir damage at the interval, and/or other well related parameters.

The test data is transmitted to control system 56 via data transmission system 54, as illustrated by block 108. In this embodiment, test data is transmitted in real time to facilitate the rapid testing and treating of the well interval. Once received, control system 56 is used to automatically process and analyze the collected sensor data, as represented by block 110. The control system 56 also can be used to automatically determine appropriate solutions, e.g. treatments, based on the analyzed data, as illustrated by block 112. Alternatively, human evaluation, in whole or in part, can be used to select suitable treatment solutions and procedures based on the testing results obtained at block 110. The well interval is then treated via well test and treatment string 32, as illustrated by block 114. For example, appropriate treatment fluids with various additives and chemicals can be pumped downhole and directed into the surrounding interval via port 70.

Following treatment of the interval, one option is to utilize sensors 68 and control system 56 to evaluate the effects of the treatment, as represented by block 116. Based on the post-treatment testing results, a decision can be made, as represented by decision block 117, whether to retreat the current interval or to move to the next step of the procedure. If the treatment result is not ideal, further well enhancement can be conducted using more of the previously selected treatment fluids and chemicals or new fluids and chemicals. The operation effectively goes back to block 112. However, if the treatment result is satisfactory, a decision is made as to whether the next interval is tested and/or treated, as represented by decision block 118. The isolation mechanism 60 is then released to enable movement of well test and treatment string 32 to the next interval to be tested, or the string 32 can be pulled out of the borehole to terminate the operation. If testing and/or treatment of another interval is continued, the operation goes back to block 100. The subsequent interval is then similarly tested and treated, as described with reference to block 102 through block 116, and this process can be repeated for each subsequent interval. If no additional wellbore intervals require testing and/or treatment, the operation is terminated, as represented by block 120.

Figure 5:
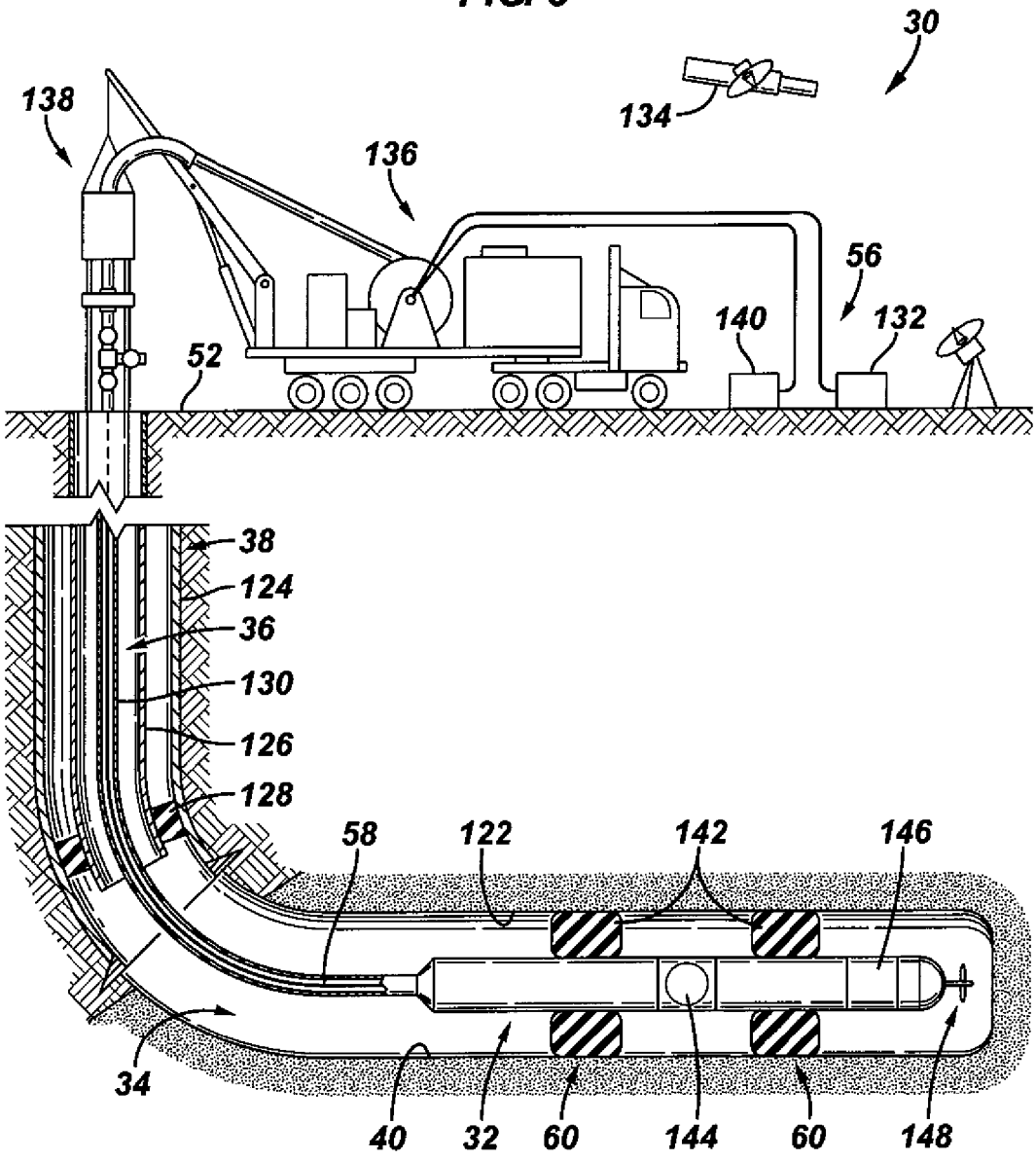
FIG. 5 is a front elevation view of the well system deployed in a deviated wellbore, according to an alternate embodiment of the present invention.

A specific embodiment of well system 30 that can be used to carry out the methodology described above is illustrated in FIG. 5. In this embodiment, the deviated section 40 of wellbore 34 is an open hole bore 122, and the vertical section 38 has a casing 124. Additionally, a production tubing 126 extends down through vertical section 38 to a production tubing packer 128.

Conveyance 36 comprises coil tubing 130 that extends down through production tubing 126 to deliver well test and treatment string 32 into open hole bore 122. The wireline 58 is deployed within coil tubing 130 for carrying data between well test and treatment string 32 and control system 56 which is positioned at a surface location. By way of example, control system 56 comprises a computer 132 disposed at the surface location so that wireline 58 can be utilized in carrying data signals between well test and treatment string 32 and computer 132 in real time. Data can be further transferred to or from remote locations via any of a variety of transfer techniques. For example, the data can be transferred wirelessly via a satellite-based system 134

In the embodiment illustrated, well test and treatment string 32 is readily movable via coil tubing 130. This enables the movement of the test and treatment string between select intervals for testing and treatment procedures. The coil tubing 130 may be coupled to a coil tubing unit 136 designed to selectively inject or lift the coil tubing 130 via a coil tubing injector 138. Other equipment also can be utilized at the surface location 52. For example, a phase tester 140 can be used to test for the phase ratio of fluid delivered to the surface through coil tubing 130.

As discussed above, well test and treatment string 32 may incorporate a variety of modules for isolating intervals, testing, treating, controlling fluid flow, handling data, and for providing other functionality to facilitate optimization of fluid production from each interval. In the example illustrated, isolation mechanism 60 comprises a packer or packers with two inflatable elements 142. However, additional packer elements can be used if more than one interval is isolated during the same time period. Additionally, the illustrated system comprises a test tool 144 for performing desired tests in each interval once inflatable packer elements 142 have isolated the desired interval. The test tool 144 can incorporate one or more flow ports 70 and one or more sensors 68 selected according to the parameters to be detected and analyzed. Furthermore, a variety of additional components can be incorporated into the well test and treatment string 32 for use either between inflatable elements 142 or outside the inflatable elements. For example, a reservoir saturation tool 146 can be located on a downhole side of the inflatable elements. Additionally, a spinner 148 can be positioned on a downhole side of the inflatable elements for determining fluid velocity.

Figure 6:
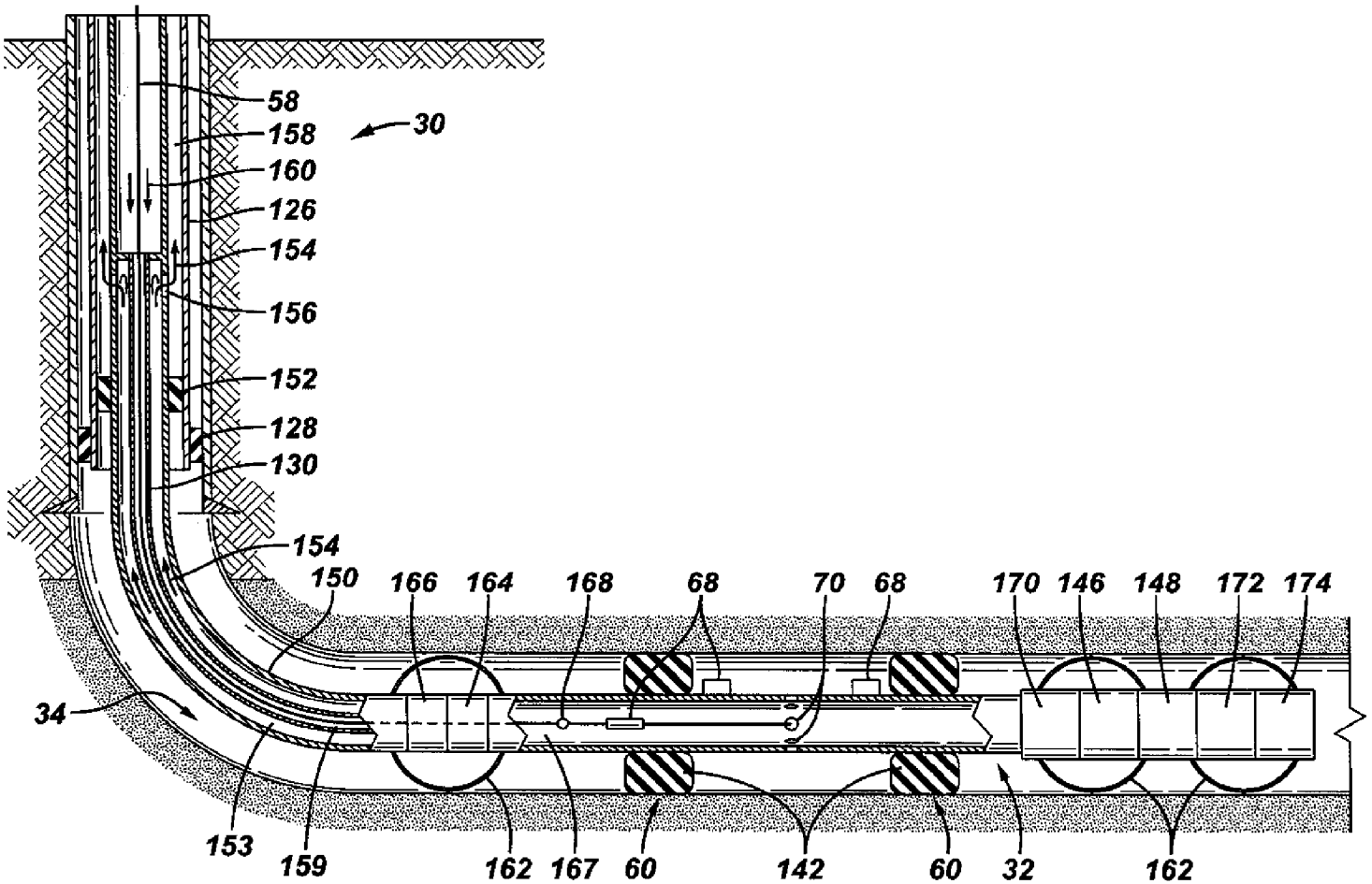
FIG. 6 is a schematic illustration of the architecture of a well system for optimizing production, according to an alternate embodiment of the present invention.

With reference to FIG. 6, other features of an embodiment of well system 30 are schematically illustrated. In this embodiment, a generally concentric tubing section 150 is deployed between well test and treatment string 32 and production tubing 126 to create fluid flow paths. An isolation member, e.g. internal packer or seal element, 152 is positioned between concentric tubing section 150 and tubing 126 to enable an upward flow channel 153, as represented by arrows 154. Fluid flowing uphole from string 32 flows along the annulus between the inner coil tubing 130 and the outer tubing of concentric tubing section 150 until directed outwardly through flow ports 156 and into an annulus 158 between coil tubing 130 and production tubing 126. However, treatment fluid or other fluid can flow downwardly through an interior channel 159 of concentric tubing section 150, as represented by arrows 160, to well test and treatment string 32. Functionally, the concentric tubing section allows injection (downward flow through interior channel 159) and production (upward flow through outer flow channel 153). The upward flow is diverted to the annulus between the conventional coil tubing 130 and production tubing 126 above the sealing packer 152. As a result of this design, the concentric tubing section 150 need not be used along the entire well length. However, the upward flow of fluid is contained by flow channel 153 to avoid affecting the open-hole formation at or below the heel of the well.

In the embodiment illustrated in FIG. 6, one or more centralizers 162 are used to centralize well test and treatment string 32 in a horizontal section of wellbore 34. Additionally, the well test and treatment string 32 may comprise an electric submersible pumping system 164 coupled to coil tubing 130 and concentric tubing section 150 by an appropriate flow control member, such as coil tubing head 166. Coil tubing head 166 is designed to properly control the downward and upward fluid flow such that fluid is allowed to flow downwardly from an upper section of the coil tubing 130 and through the lower section of tubing, e.g. coil tubing, which forms the internal tubing of concentric tubing section 150. The downward flow of fluid is further controlled through the inside of a bottom flow channel 167 and through flow ports 70 to the formation interval between the inflatable elements 142. Coil tubing head 166 also allows fluid to flow from the formation and then upwardly from the formation through flow ports 70, through the inside of bottom flow channel 167, through concentric tubing section 150, and through the flow control sub 156. Flow control sub 156 then directs the flow of fluid to the annulus 158 between the upper section of the coil tubing 130 and the production tubing 126. Flow control member 166 also prevents unwanted communication of fluid flow between flow channels 153 and 159 of concentric tubing section 150.

The electric submersible pumping system 164 can be used to pump fluid upwardly along flow path 154 and/or downwardly into the desired interval being tested and treated. In this embodiment, isolation mechanism 60 comprises a straddle packer having inflatable elements 142. In an alternate embodiment, control over the downward and upward of fluid flow can be accomplished with control valve 168. In some applications, control valve 168 can be connected to coil tubing head 166, and the electric submersible pumping system 164 can be removed.

Flow into or out of ports 70 can be controlled by a shut-in valve 168. Additionally, one or more sensors 68 can be positioned to sense specific parameters of the fluid flowing through ports 70. Sensors 68 also can be positioned at other locations to detect or measure various parameters during the testing and evaluation procedures.

Many other components can be incorporated into well test and treatment string 32 to facilitate various testing, treatment and evaluation procedures. For example, string 32 may comprise a gamma ray tool 170, reservoir saturation tool 146, spinner 148, a caliper 172 to measure bore hole diameter, and a multilayer transient test tool 174 to ensure entry into the proper lateral wellbore. However, a variety of alternate, additional or other components can be incorporated into well test and treatment string 32 to form a variety of other modules for use in the testing, treatment, and evaluation procedures carried out during a single run downhole.

The various components described above can be utilized individually or in various combinations to form the modules 82, discussed above with reference to FIG. 3. By way of example, the zonal isolation module 84 can be created by constructing isolation mechanism 60 in the form of a straddle packer designed to isolate the intervals, e.g. intervals 44, 46, 48, for testing and treatment procedures. The testing module 86 can be formed by combining shut-in valve 168 with sensors 68, e.g. pressure sensors, and the corresponding electronics and control features for controlling the actuation of shut-in valve 168. For example, valve 168 may comprise a multi-position valve actuated with linear actuators and/or solenoid valves. Furthermore, production logging module 88 may comprise a combination of logging components, such as spinner 148, reservoir saturation tool 146, gamma ray tool 170, and caliper 172. The logging module and its various components can be used to locate poor performing areas along the deviated wellbore 34.

Other components also can be selected to form the various other modules. For example, the conveyance and flow module 90 can be constructed with components arranged to create the desired flow paths. In one embodiment, coil tubing 130, concentric section 150, and appropriate valving cooperate with isolation mechanism 60 to control flow during testing procedures, cleanup procedures, and treatment procedures. The lateral entry module 92 can be formed with multilayer transient test tool 174 which is used to locate and provide access to multi-lateral wellbores. The remedial or treatment module 94 comprises coil tubing 130 combined with appropriate valving to control the flow of treatment materials into a desired interval. For example, this module and its components can be used for matrix stimulation, acidizing, water shut off, and other treatment procedures. Another module that can be utilized in well system 30 is a lift system module that may comprise, for example, electric submersible pumping system 164 or other suitable artificial lift mechanisms, such as gas lifts or jet pumps.

Various secondary or support modules also can be constructed with a variety of components. For example, telemetry and control module 96 may be formed with an appropriate data transmission system, such as wireline 58. Depending on the specific type of data transmission system selected, various other components, e.g., bulkheads, surface control interfaces, etc., can be incorporated into the telemetry and control module. Module 96 and its components enable real time data acquisition as well as downhole tool control. The interpretation and answer module 98 can be incorporated into control system 56 to facilitate a variety of supporting functionality, including candidate selection, job design, interpretation, treatment prediction, monitoring and controlling. Examples of suitable software programs that can be used in the interpretation and answer module 98 for a variety of well related applications comprise Job Design™, CoilCADE™, StimCADE™, and various interpretation software. These and other modules can be utilized in well system 30 to facilitate the testing and treatment of multiple, individual well intervals during a single run into a deviated wellbore. Additionally, the telemetry and control module enables transmission of data in real time to afford immediate testing, analysis, treatment, and/or evaluation at each well interval.

The embodiments described above provide examples of well systems that facilitate detailed understanding and effective enhancement of production from deviated, e.g. horizontal, wellbores. Examples are provided of suitable well test and treatment strings as well as other modules that work in cooperation with the well test and treatment strings. However, the functionality of the various modules can be adjusted according to the well environment and the specific testing and treatment procedures anticipated for a given job. Additionally, the size, shape, and configuration of the various components can be adjusted according to the specific application and desired procedures.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of optimizing well production, comprising:

selecting a first interval along a horizontal part of a wellbore;

isolating the first interval with an isolation mechanism of a test string deployed into the horizontal part of the wellbore;

performing a test to obtain data on the first interval;

processing the data on a control system in real time;

implementing a first action to enhance production at the first interval based on results from processing the data, wherein implementing the first action is performed without removing any part of the test string from the wellbore, wherein implementing the first action comprises removing damage and improving permeability of the first interval;

the control system using data collected by a sensor to evaluate results from performing the first action;

when the results indicate that further action is to be taken for the first interval, implementing a second action to enhance production at the first interval;

the control system using data collected by the sensor to evaluate results from performing the second action; and when the results from performing the second action indicate that no further action is to be taken for the first interval, releasing the isolation mechanism and moving the test string to a second interval to perform testing and treatment of the second interval, wherein implementing the first action and the second action with respect to the first interval comprises injecting treating fluids to the first interval through a concentric tubing section of the test string, wherein the treating fluids are injected through an inner flow channel of the concentric tubing section to the first interval;

producing fluids from the first interval through an outer flow channel of the concentric tubing section to an annular region defined between the concentric tubing section and a production tubing placed inside casing lining the wellbore, wherein the outer flow channel is concentrically arranged around the inner flow channel.

2. The method of claim 1, wherein injecting the treating fluids comprises injecting the treating fluids from an earth surface through coil tubing, wherein a portion of the coil tubing provides the inner flow channel of the concentric tubing section.

3. The method of claim 1, further comprising providing a flow control member to prevent fluid communication between the inner and outer flow channels of the concentric tubing section.

4. A system, comprising:

a well test and treatment string for deployment in a horizontal part of a wellbore, the well test and treatment string having an isolation mechanism to selectively isolate well zones along the horizontal part of the wellbore;

a control system to process test data;

a data transmission system to convey test data from the well test and treatment string to the control system for analysis in determining a specific action to optimize production from a specific well zone tested;

a production tubing to position inside casing of the wellbore;

a concentric tubing section to provide flow paths for flowing fluid during a well test and treatment procedure, wherein the concentric tubing section has an outer flow channel and an inner flow channel to provide the flow paths, wherein the outer flow channel is an annular flow channel concentrically arranged around the inner flow channel;

an isolation member to isolate an annulus between the concentric tubing section and the production tubing; and a flow control sub to divert upward fluid flow from the outer flow channel of the concentric tubing section to the annulus between the concentric tubing section and the production tubing, wherein the annulus is above the isolation member, and wherein the inner flow channel is configured to carry a downward fluid flow.

5. The system as recited in claim 4, further comprising a flow control member to control downward flow of fluid from an upper tubing section through the inner flow channel and into a bottom flow channel, and to a formation interval between a pair of inflatable elements of the isolation mechanism.

6. The system as recited in claim 5, wherein the flow control member is to control upward flow as fluid flows from the formation interval between the pair of inflatable elements, and into the outer flow channel of the concentric tubing section while sealing off communication between the outer flow channel and the inner flow channel of the concentric tubing section.

7. The system as recited in claim 4, wherein the isolation mechanism comprises a pair of expandable packer elements.

8. The system as recited in claim 4, wherein the isolation mechanism comprises a pair of inflatable elements.

9. The system as recited in claim 4, wherein the data transmission system comprises a wireline.

10. A method of optimizing well production, comprising:

sequentially isolating, using a test string, a plurality of intervals along a deviated part of a wellbore;

testing and treating, using the test string, each interval of the plurality of intervals during a single trip into the deviated wellbore;

using a flow control member to control flow along a plurality of flow paths in a concentric tubing section of the test string during a testing and treatment procedure, wherein the concentric tubing section has an inner flow path and an outer flow path, wherein the outer flow path is concentrically arranged around the inner flow path, one of the inner and outer flow paths to inject fluid to a selected one of the intervals, and the other of the inner and outer flow paths to produce fluid from the selected interval; and communicating fluid flow between the outer flow path and an annulus between the concentric tubing section and a production tubing that is deployed inside casing lining a portion of the wellbore.

11. The method as recited in claim 10, wherein sequentially isolating comprises utilizing a pair of packer elements of the test string to selectively isolate each interval.

12. The method as recited in claim 10, further comprising evaluating each interval after treatment of each interval.

13. The method of claim 12, wherein testing a particular one of the intervals is performed with the test string in a first position, and wherein treatment of the particular interval is performed without removing any part of the test string that is at the first position, the method further comprising:

as part of evaluating the particular interval, determining whether a result of the treatment of the particular interval indicates that no further treatment of the particular interval is to be performed;

in response to determining that the result indicates that further treatment of the particular interval is to be performed, re-treating the particular interval with the test string at the first position and without redeploying any part of the test string.

* * * * *